US007322773B1

(12) United States Patent
Cooper

(10) Patent No.: US 7,322,773 B1
(45) Date of Patent: Jan. 29, 2008

(54) POST MOUNTING ASSEMBLY

(76) Inventor: Gary A. Cooper, 242 Plimton St., Walpole, MA (US) 02081

( * ) Notice: Subject to any disclaimer, the term of this patent is extended or adjusted under 35 U.S.C. 154(b) by 0 days.

(21) Appl. No.: 11/363,453

(22) Filed: Feb. 28, 2006

(51) Int. Cl.
*E02B 11/00* (2006.01)
*E01C 3/00* (2006.01)

(52) U.S. Cl. ..... 405/36; 52/180; 52/169.1

(58) Field of Classification Search ..... 405/229, 405/230, 244, 32, 35, 36; 52/180, 169.1
See application file for complete search history.

(56) References Cited

U.S. PATENT DOCUMENTS 4,198,793 A 4/1980 Sato et al.
4,211,049 A 7/1980 Fischer
4,614,070 A 9/1986 Idland
5,123,623 A 6/1992 McNamara
5,404,682 A 4/1995 West
5,666,774 A * 9/1997 Commins ..... 52/298
5,809,700 A 9/1998 Roush et al.

* cited by examiner

*Primary Examiner*—Tara L. Mayo

(57) ABSTRACT

A post mounting assembly includes a rod has an upper end, a lower end and a peripheral surface extending between the upper and lower ends. The rod has an upper portion and a lower portion relative to a central area of the rod. The upper portion includes the upper end. The peripheral surface of the upper portion has a first threading and the peripheral surface of the lower portion has a second threading. The upper end is extended into an aperture extending into a bottom end of a fence post and threadably coupled to the fence post. The lower end is extended into a ground surface.

5 Claims, 4 Drawing Sheets

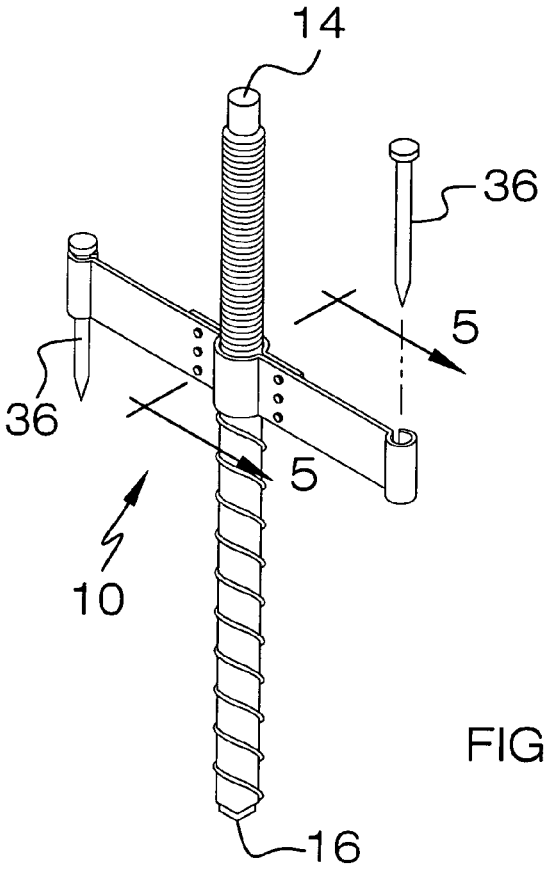
FIG. 3
FIG. 4
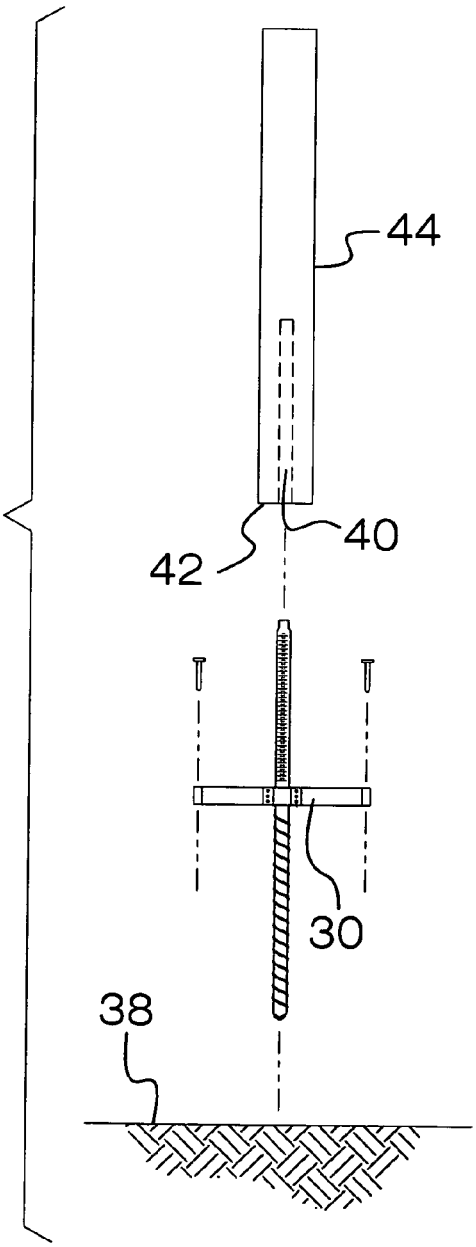

POST MOUNTING ASSEMBLY

BACKGROUND OF THE INVENTION

1. Field of the Invention

The present invention relates to post mounting devices and more particularly pertains to a new post mounting device for vertically supporting a fence post with respect to a ground surface.

2. Description of the Prior Art

The use of post mounting devices is known in the prior art. While these devices fulfill their respective, particular objectives and requirements, the need remains for a device that assists a person in mounting a fence post to a ground surface so that the fence post extends upwardly from the ground and which prevents the fence post from having to touch the ground surface. This will prevent rot and water damage to the fence post as well as allow for easy mounting of a fence post.

SUMMARY OF THE INVENTION

The present invention meets the needs presented above by generally comprising a rod has an upper end, a lower end and a peripheral surface extending between the upper and lower ends. The rod has an upper portion and a lower portion relative to a central area of the rod. The upper portion includes the upper end. The peripheral surface of the upper portion has a first threading and the peripheral surface of the lower portion has a second threading. The upper end is extended into an aperture extending into a bottom end of a fence post and threadably coupled to the fence post. The lower end is extended into a ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the present invention.

FIG. 4 is a side view of the present invention.

DESCRIPTION OF THE PREFERRED EMBODIMENT

Figure 1:
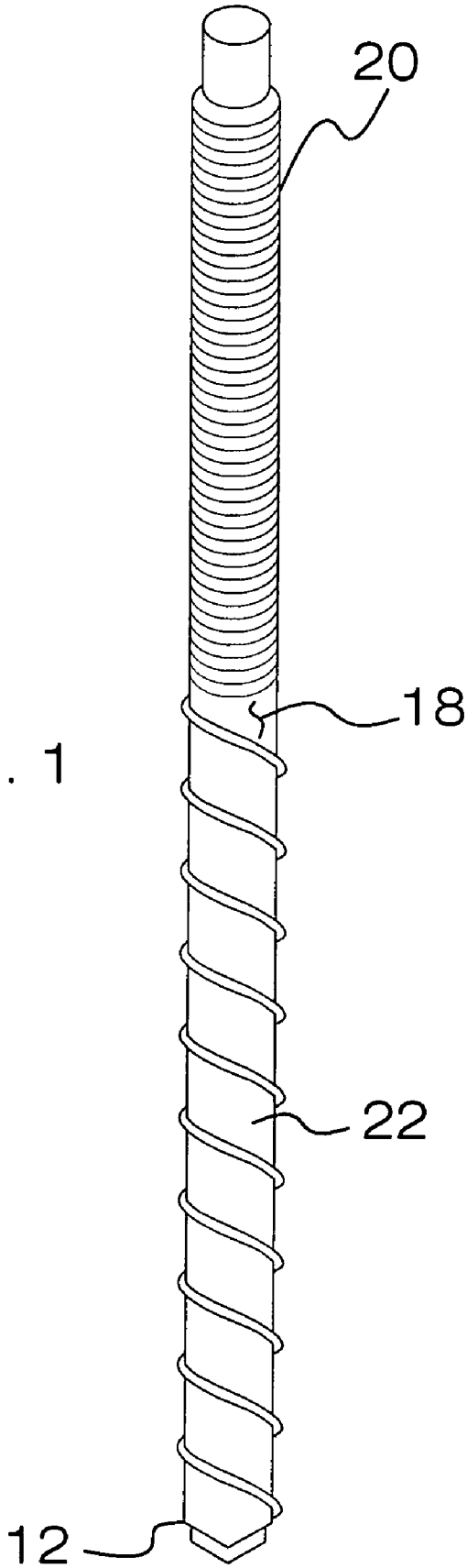
FIG. 1 is a perspective view of a rod of a post mounting assembly according to the present invention.
Figure 2:
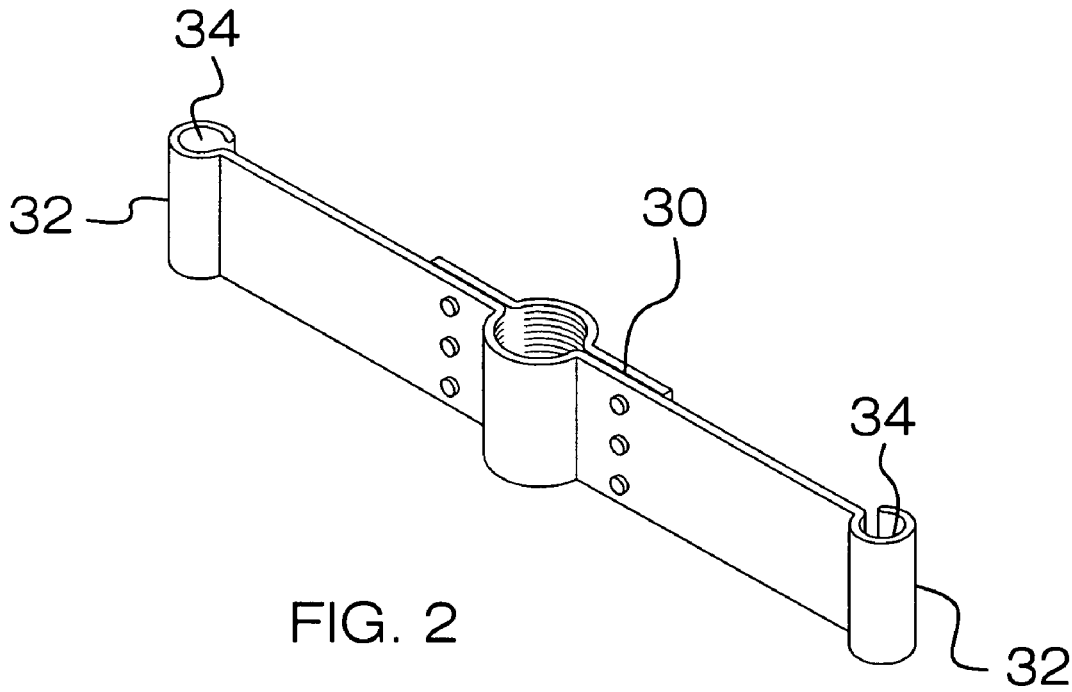
FIG. 2 is a perspective view of a support arm of the present invention.
Figure 5:
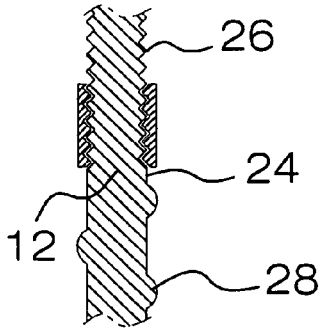
FIG. 5 is a cross-sectional view of the present invention taken along line 5-5 of FIG. 3.
Figure 6:
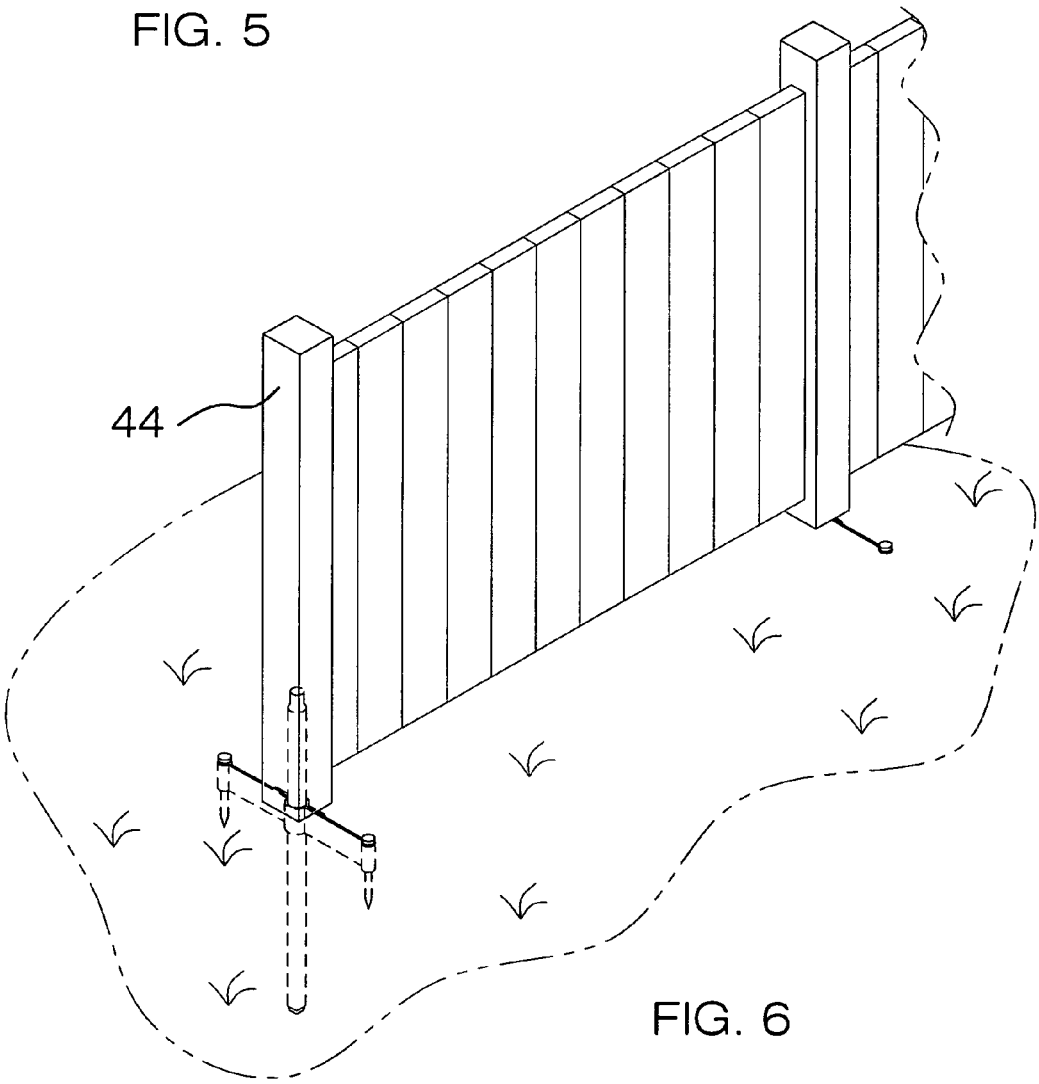
FIG. 6 is a perspective in-use view of the present invention.

With reference now to the drawings, and in particular to FIGS. 1 through 6 thereof, a new post mounting device embodying the principles and concepts of the present invention and generally designated by the reference numeral 10 will be described.

As best illustrated in FIGS. 1 through 6, the post mounting assembly 10 generally comprises a rod 12 that has an upper end 14, a lower end 16 and a peripheral surface 18 extending between the upper 14 and lower 16 ends. The rod 12 has an upper portion 20 and a lower portion 22 relative to a central area 24 of the rod 12. The upper portion 20 includes the upper end 14. The peripheral surface 18 of the upper portion 20 has a first threading 26 and the peripheral surface 18 of the lower portion 22 has a second threading 28. The second threading 28 has wider spaced threads with respect to the first threading 26 and the second threading 28 extends outwardly from the peripheral surface 18 further than the first threading 26. This allows the second threading 28 to grab into soil while the first threading allows 26 it to grip wood. The lower end 16 of the rod 12 is pointed.

A support arm 30 is threadably coupled to the upper portion 20 adjacent to the central area 24. The support arm 30 has a pair of outer ends 32 extending outwardly from the rod 12 in opposite directions with respect to each other. Each of the outer ends 32 has an opening 34 extending therethrough. The openings 34 each has an axis that is orientated parallel to a longitudinal axis of the rod 12. A pair of stake members 36 is provided. Each of the stake members 36 is extendable through one of the outer ends and into a ground surface 38.

In use, the upper end 14 of the rod 12 is extended into an aperture 40 extending into a bottom end 42 of a fence post 44 and threadably coupled to the fence post 44. The lower end 16 is extended into the ground surface 38 by rotating the post 44 and driving the rod 12 into the ground surface 38. The support arm 30 and stake members 36 assist in stabilizing the fence post 44 while ensuring the fence post 44 remains off of the ground surface 38.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A post supporting apparatus for removably coupling to a bottom end of a fence post, said apparatus comprising:

a rod having an upper end, a lower end and a peripheral surface extending between said upper and lower ends, said rod having an upper portion and a lower portion relative to a central area of said rod, said upper portion including said upper end, said peripheral surface of said upper portion having a first threading and said peripheral surface of said lower portion having a second threading, wherein said upper end is extended into an aperture extending into the bottom end of the fence post and threadably coupled to the fence post, wherein said lower end is extended into a ground surface; and a support arm being threadably coupled to said upper portion adjacent to said central area, said support arm having a pair of outer ends extending outwardly from said rod in opposite directions with respect to each other, each of said outer ends having an opening extending therethrough having an axis orientated parallel to a longitudinal axis of said rod; and a pair of stake members, each of said stake members being extendable through one of said outer ends and into the ground surface.

2. The apparatus according to claim 1, wherein said second threading has wider spaced threads with respect to said first threading, said second threading extending outwardly from said peripheral surface further than said first threading.

3. The apparatus according to claim 1, wherein said lower end of said rod is pointed.

4. The apparatus according to claim 2, wherein said lower end of said rod is pointed.

5. A post supporting apparatus for removably coupling to a bottom end of a fence post, said apparatus comprising:

a rod having an upper end, a lower end and a peripheral surface extending between said upper and lower ends, said rod having an upper portion and a lower portion relative to a central area of said rod, said upper portion including said upper end, said peripheral surface of said upper portion having a first threading and said peripheral surface of said lower portion having a second threading, said second threading having wider spaced threads with respect to said first threading, said second threading extending outwardly from said peripheral surface further than said first threading, said lower end of said rod being pointed, wherein said upper end is extended into an aperture extending into the bottom end of the fence post and threadably coupled to the fence post, wherein said lower end is extended into a ground surface;

a support arm being threadably coupled to said upper portion adjacent to said central area, said support arm having a pair of outer ends extending outwardly from said rod in opposite directions with respect to each other, each of said outer ends having an opening extending therethrough having an axis orientated parallel to a longitudinal axis of said rod; and a pair of stake members, each of said stake members being extendable through one of said outer ends and into the ground surface.

* * * * *